US010359246B2

(12) United States Patent
Faughn

(10) Patent No.: US 10,359,246 B2
(45) Date of Patent: Jul. 23, 2019

(54) MAGAZINE ASSEMBLY

(71) Applicant: U.S. Army Research Laboratory, Adelphi, MD (US)

(72) Inventor: Jim A. Faughn, Glen Arm, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/480,660

(22) Filed: Sep. 9, 2014

(65) Prior Publication Data

US 2015/0267981 A1 Sep. 24, 2015

Related U.S. Application Data

(60) Provisional application No. 61/896,878, filed on Oct. 29, 2013.

(51) Int. Cl.
*F41A 9/62* (2006.01)

(52) U.S. Cl.
CPC ..... *F41A 9/62* (2013.01)

(58) Field of Classification Search
CPC ..... F41A 9/72; F41A 9/65; F41A 9/62
See application file for complete search history.

(56) References Cited

U.S. PATENT DOCUMENTS 784,786 A * 3/1905 Gottardi ..... F41A 9/62 42/1.02
2,252,330 A * 8/1941 Nothe ..... F41A 9/62 235/124
2,303,479 A * 12/1942 Lesnick ..... F41A 9/62 235/144 E
2,565,891 A * 8/1951 Sherman ..... E05B 53/001 220/230
2,828,568 A * 4/1958 Sakewitz ..... F41A 9/62 42/1.02
3,572,310 A * 3/1971 Kensuke ..... F41A 9/62 124/31
3,790,197 A * 2/1974 Parker ..... E05C 19/16 292/251.5
4,109,401 A * 8/1978 Musgrave ..... F41A 9/62 42/1.01
4,142,313 A * 3/1979 Musgrave ..... F41A 9/62 42/1.02
4,216,601 A * 8/1980 Musgrave ..... F41A 9/62 42/1.02
4,219,953 A * 9/1980 Musgrave ..... F41A 9/62 42/1.02

(Continued)

*Primary Examiner* — Joshua E Freeman
*Assistant Examiner* — Bridget Cochran
(74) *Attorney, Agent, or Firm* — Alan I. Kalb

(57) ABSTRACT

A magazine assembly having an elongated housing with a channel dimensioned to contain a plurality of stacked ammunitions between a first and second end of the housing. A spring loaded follower is mounted within the housing channel and is adapted to abut against one end of the stacked ammunition adjacent the second end of the housing and urge the stacked ammunition towards the first end of the housing. A tactile indicator assembly is mounted to the housing which cooperates with the follower to indicate the position of the follower between the ends of the housing and thus the amount of ammunition remaining in the magazine.

1 Claim, 6 Drawing Sheets

(56) References Cited

U.S. PATENT DOCUMENTS 4,566,212 A * 1/1986 Chesnut ..... F41A 9/65 42/50
4,587,756 A * 5/1986 Jakubaschk ..... F41A 9/62 42/1.02
4,592,160 A * 6/1986 Bross ..... F41A 9/65 42/7
4,651,455 A * 3/1987 Geiser, Jr. ..... F41A 3/22 42/16
4,702,030 A * 10/1987 Schreiber ..... F41C 3/14 42/1.02
5,033,217 A * 7/1991 Brennan ..... F41A 3/64 42/1.01
5,052,138 A * 10/1991 Crain ..... F41A 9/62 42/1.02
5,074,189 A * 12/1991 Kurtz ..... F41A 5/20 42/50
5,206,444 A * 4/1993 Oliver ..... F41A 9/62 42/1.02
5,291,679 A * 3/1994 Wollack ..... F41A 9/67 42/50
5,303,495 A * 4/1994 Harthcock ..... F41A 9/62 42/1.02
5,450,683 A * 9/1995 Miller, IV ..... F41A 9/65 221/278
5,519,953 A * 5/1996 Villani ..... F41A 9/62 42/1.02
5,592,769 A * 1/1997 Villani ..... F41A 9/62 42/1.02
5,642,581 A * 7/1997 Herold ..... F41A 9/62 42/1.02
5,697,179 A * 12/1997 Vanmoor ..... F41A 9/65 42/50
5,826,360 A * 10/1998 Herold ..... F41A 9/62 42/1.02
6,094,850 A * 8/2000 Villani ..... F41A 9/62 42/1.02
6,976,715 B2 * 12/2005 Lyon ..... E05C 19/16 292/251.5
7,536,816 B2 * 5/2009 Weinberger ..... F41A 9/62 42/1.02
7,762,817 B2 * 7/2010 Ligtenberg ..... H01R 13/74 439/38
7,908,780 B2 * 3/2011 Fitzpatrick ..... F41A 9/65 42/50
8,356,400 B2 * 1/2013 Fullerton ..... H01F 7/0284 29/607
8,373,527 B2 * 2/2013 Fullerton ..... H01F 7/021 335/285
8,484,809 B2 * 7/2013 Fiedler ..... A45C 13/1069 220/230
8,540,292 B2 * 9/2013 Ferguson ..... E05C 17/56 24/303
9,217,614 B2 * 12/2015 Pizano ..... F41A 3/26
9,273,925 B1 * 3/2016 Liao ..... F41A 17/36
2004/0154207 A1 * 8/2004 Conner ..... F41A 9/65 42/49.01
2005/0011097 A1 * 1/2005 Freed ..... F41A 9/65 42/49.02
2006/0053671 A1 * 3/2006 Weinberger ..... F41A 9/62 42/1.01
2008/0127538 A1 * 6/2008 Barrett ..... F41A 9/62 42/1.02
2008/0276517 A1 * 11/2008 Delgado ..... F41A 9/62 42/1.02
2009/0094875 A1 * 4/2009 Kim ..... F41A 9/62 42/1.02
2010/0115815 A1 * 5/2010 Gur-Ari ..... F41A 9/62 42/1.02
2010/0281725 A1 * 11/2010 Arbouw ..... F41A 9/62 42/1.02
2011/0030257 A1 * 2/2011 Gwillim, Jr. ..... F41A 9/62 42/1.02
2011/0078936 A1 * 4/2011 Gates ..... F41A 9/62 42/1.02
2011/0308125 A1 * 12/2011 Gabay ..... F41A 9/62 42/1.02
2012/0122058 A1 * 5/2012 Jensen ..... F41A 9/62 434/16
2013/0180143 A1 * 7/2013 Delgado ..... F41A 9/71 42/1.02
2014/0223792 A1 * 8/2014 Socivoi ..... F41A 9/82 42/50
2014/0250750 A1 * 9/2014 Williams ..... F41A 9/62 42/1.02
2014/0311003 A1 * 10/2014 Loreman ..... F41A 9/62 42/1.02
2015/0075052 A1 * 3/2015 Boyarkin ..... F41A 9/67 42/87
2015/0267981 A1 * 9/2015 Faughn ..... F41A 9/62 42/1.02
2015/0316341 A1 * 11/2015 Aguilar ..... F41A 9/83 42/87
2016/0003568 A1 * 1/2016 Spykerman ..... F41A 9/62 42/6
2016/0195351 A1 * 7/2016 Burden ..... F41A 9/62 42/1.02

* cited by examiner

MAGAZINE ASSEMBLY

GOVERNMENT INTEREST

The invention described herein may be manufactured, used, and licensed by or for the United States Government.

BACKGROUND OF THE INVENTION

I. Field of the Invention

The present invention relates generally to weaponry and, more particularly, to a magazine for a firearm.

II. Description of Related Art

There are many previously known magazines that are used to store and provide ammunition for weapons and firearms of all different sizes, calibers, and configurations. These previously known magazines typically include a housing defining a channel in which stacked ammunition is contained. A spring loaded follower is also contained within the channel and abuts against a lower end of the stacked ammunition. The spring then urges the stack of ammunition toward the upper end, i.e. the end attached to the firearm, thus urging ammunition from the magazine into the ammunition loading chamber of the firearm.

Although there are many types of different magazines used with firearms, a box magazine is most commonly used for firearms, both automatic, semi-automatic, and manual. These previously known box cartridges typically comprise an elongated housing defining a channel in which the stacked ammunition is contained. The number of rounds of ammunition contained within the magazine will, of course, vary from one firearm and to another.

In order to urge the ammunition into the loading chamber of the firearm, a spring loaded follower is contained within the channel of the housing. This spring loaded follower, furthermore, abuts against a lower end of the stack of ammunition within the magazine chamber and urges the ammunition stack within the magazine toward the other end of the magazine, i.e., the end of the magazine attached to the firearm. Consequently, the follower urges the ammunition stack into the loading chamber for the firearm.

In many situations, it would be desirable to be able to rapidly determine the amount of ammunition remaining within the magazine. Such information would be particularly advantageous in combat situations.

Previously, the only mechanism to identify the amount of ammunition remaining within the magazine has been to provide a slot extending longitudinally along the magazine housing so that the bottom of the ammunition stack can be viewed through the slot. In some cases, the slot is filled with a transparent material, such as transparent plastic.

This previously known mechanism for allowing the shooter to determine how many rounds of ammunition remain within the magazine, however, has not proven wholly successful in use. Specifically, in order for the shooter to determine the position of the bottom of the stack, it is necessary for the shooter to take his or her eyes off of the intended target and to look through the slot. This however, is unacceptable in many situations such as combat situations, where it is desirable for the soldier to keep his or her eyes on the intended target at all times.

A still further disadvantage of these previously known magazines with a longitudinally extending slot is that it is not possible to see the bottom of the ammunition stack at nighttime or in other situations where there is simply insufficient light to view the bottom of the ammunition stack. This also is unacceptable in many situations, such as combat situations.

SUMMARY OF THE PRESENT INVENTION

The present invention provides a magazine assembly which overcomes all of the above mentioned disadvantages of the previously known magazine assemblies by providing a magazine assembly with a tactile indicator of the amount of ammunition remaining within the magazine.

In brief, the present invention comprises a magazine assembly having an elongated housing which defines a channel dimensioned to receive and contain a plurality of stacked ammunition so that the stack extends between an upper or first end of the housing and a second or lower end of the housing. The actual dimension tor the channel will vary depending upon the ammunition type and caliber, as well as the amount of ammunition which the magazine can contain.

A spring loaded follower is mounted within the housing channel adjacent its lower or second end and this follower is adapted to abut against one end of the stacked ammunition within the magazine channel. The follower thus urges the stack of ammunition towards the upper or a first end of the ammunition housing. The first end of the ammunition housing is attached to the firearm and open to the ammunition loading chamber of the firearm.

A tactile indicator assembly is mounted to the housing. This tactile indicator assembly cooperates with the follower to indicate the position of the follower between the first and second ends of the housing. The position of the follower, of course, will move from the second and towards the first end of the magazine as the firearm discharges or fires the ammunition from the firearm. Consequently, the position of the follower within the magazine chamber provides an indication of the amount of ammunition remaining within the magazine.

In one embodiment of the invention, a plurality of pins are movably mounted to the elongated housing so that the pins are longitudinally spaced from each other between the first and second ends of the magazine housing. Each pin is movable between an extended and a retracted position while a spring or other biasing mechanism is employed to urge each of the pins towards its retracted position.

All of the pins cooperate with the follower so that, when the follower is aligned with the pins, the follower moves the pins from their retracted position and to an extended position such that the pins protrude exteriorly of the magazine housing. Consequently, a soldier may identify the longitudinal position of the follower within the magazine channel, and thus the amount of remaining ammunition within the magazine, by merely manually identifying which of the pins has been forced by the follower to its extended position. Since this may be achieved by the soldier merely rubbing his or her finger or thumb along the magazine in the area of the pins and identifying the outwardly extending pin, the soldier is able to identify the amount of ammunition remaining within the magazine. Furthermore, this can all be done without the soldier taking his or her eyes off of the current target.

The actual cooperation between the individual pins and the follower may assume any of several different forms.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
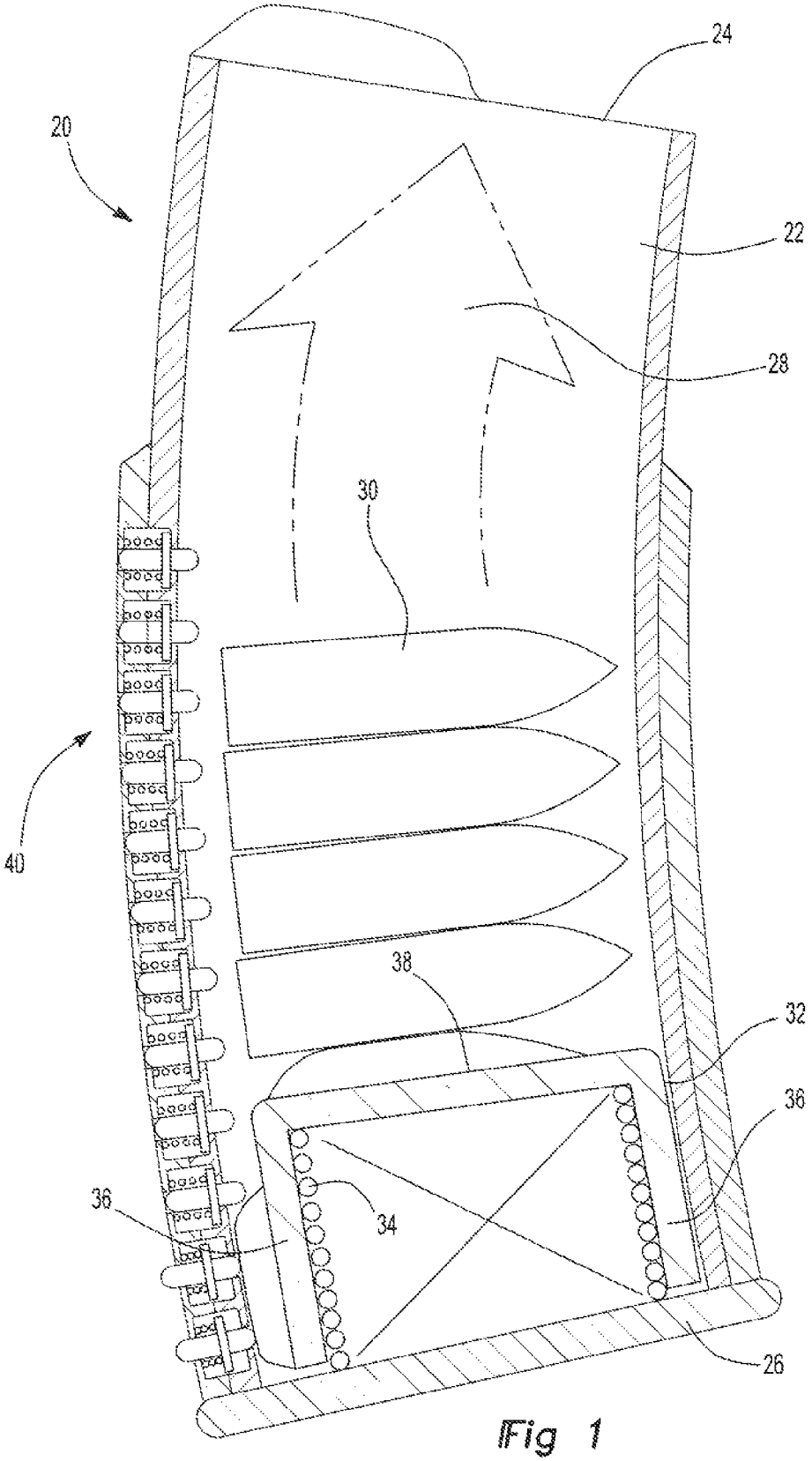
FIG. 1 is a side partial fragmentary view illustrating a preferred embodiment of the present invention.

With reference first to FIG. 1, a preferred embodiment of a magazine assembly 20 according to the present invention is shown. The magazine assembly 20 is shown in FIG. 1 as a box magazine and is by way of illustration only. Other types of magazines may be used without deviation from the spirit or scope of the invention.

Still referring to FIG. 1, the magazine assembly 20 includes an elongated housing 22 having a first or upper end 24 and a second or lower end 26. The magazine housing may be constructed of any conventional material, such as plastic or metal, and defines an elongated channel 28 which is dimensioned to contain a stack of ammunition 30. The actual dimension of the channel 28 will vary depending upon the caliber and type of ammunition 30 contained by the magazine 20.

The upper end 24 of the magazine housing 22 is adapted for detachable connection with a firearm. The upper end 24 is positioned in alignment with an ammunition loading chamber on the firearm. Thus, in the conventional fashion, as the ammunition 30 moves into the loading chamber and is subsequently discharged by the firearm, the stack 30 of ammunition moves upwardly within the housing chamber 28.

In order to urge the ammunition stack 30 towards the upper end 24 of the magazine housing 22, a follow 32 is contained within the magazine channel 28. The follower 32 abuts against the lower end of the stack of ammunition 30, i.e. adjacent the second or lower end 26 of the magazine housing 22. A compression spring 34 is contained within the follower to urge the magazine stack 30 towards the upper end 24 of the housing 22.

Although the follower 32 may take different forms, typically the follower 32 is generally cup shaped having sides 36 and a top 38 which abuts against the bottom of the stack of ammunition 30. Consequently, the cup shape of the follower 32 is efficient in containing the compression spring 34 at least partially within the follower 32.

When the magazine 20 is initially completely loaded with its maximum number of shells of ammunition, the cam follower 32 is positioned adjacent the bottom 26 of the housing 22 and the spring 34 is in a state of maximum compression. Conversely, as shells are fired by the firearm, the follower 32 moves upwardly within the magazine channel 38 as shown in phantom line in FIG. 1. Consequently, the longitudinal position of the cam follower 38 within the magazine channel 28 is directly proportional to the number of ammunition shells 30 contained within the magazine 20.

Figure 2:
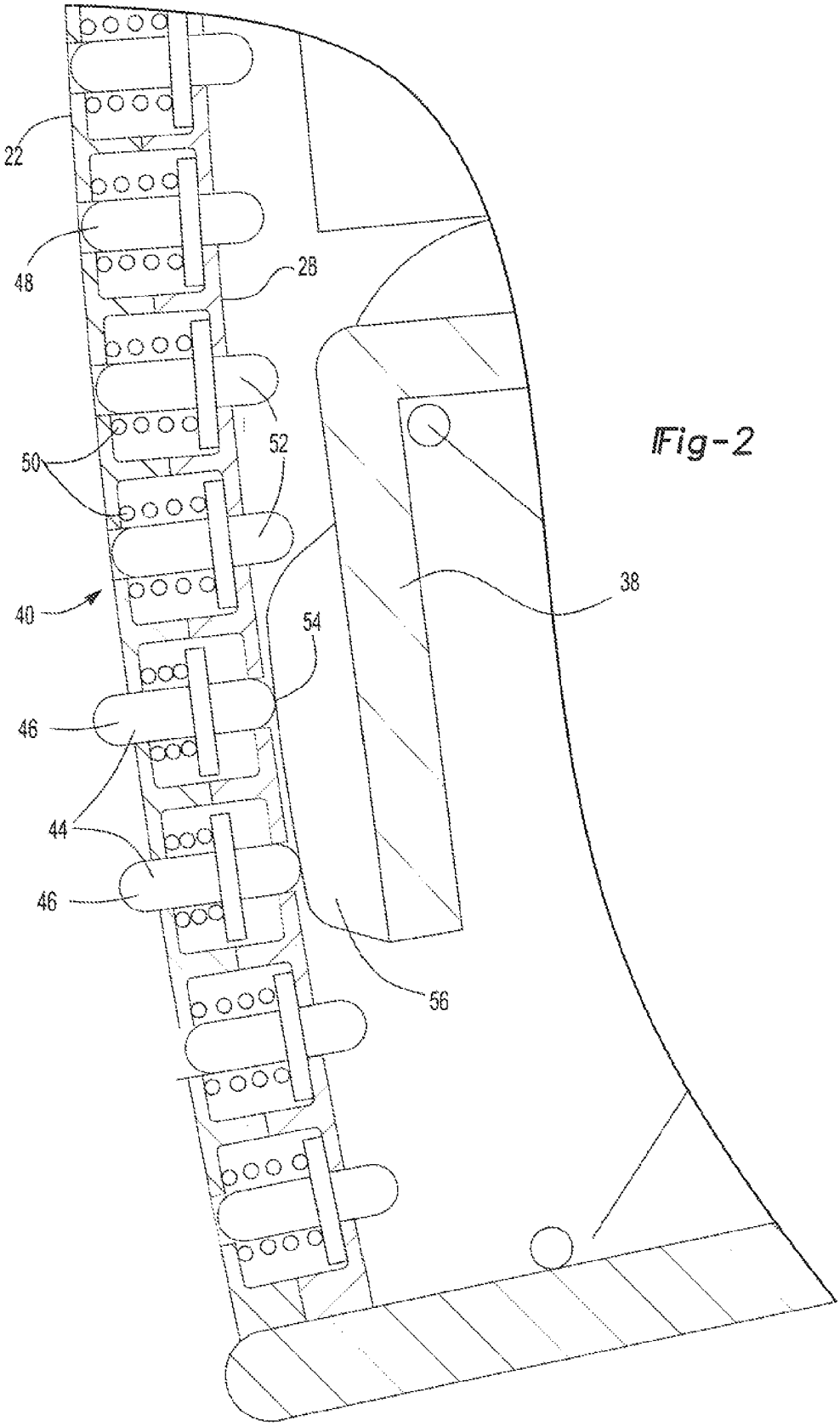
FIG. 2 is a fragmentary view illustrating a preferred embodiment of the present invention and enlarged for clarity.

With reference now to FIGS. 1 and 2, a tactile indicator assembly 40 is mounted along one side 42 of the housing 22 to provide a tactile indication of the amount of ammunition remaining within the magazine 20. In the embodiment illustrated in FIGS. 1 and 2, the tactile indicator assembly 40 includes a number of pins 44 that are movable between an extended position, as shown at 46, and a retracted position, as shown at 48. In their extended position 46, the pins 44 protrude outwardly from the side 42 of the housing whereas in their retracted position 48, the pins 44 are recessed within the side 42 of the housing 22. The pins 44, furthermore, are longitudinally spaced between the ends 24 and 26 (FIG. 1) of the housing 22.

The tactile indicator assembly 40 may be provided along one side, e.g. the back, of the magazine. However, if desired, multiple tactile indicator assemblies may be provided on the same magazine.

A resilient member 50, such as a spring, is associated with each pin 44 and urges the pin 44 towards its retracted position 48. Furthermore, the pins 44 are dimensioned so that, with the pins 44 in their retracted position 48, a portion 52 of the pin protrudes into the housing channel 28 for the magazine 20.

The pins 44 and the follower 38 are dimensioned so that, when the follower is aligned with one or more pins 44, the follower 38 manually engages and displaces the pin outwardly to its extended position 46 against the force of the compression spring 50 associated with those pins 44. Preferably, the follower includes one ort lore ramps 54 and 56 to facilitate the displacement of the pins 44 between their extended position 46 and retracted position 48.

As previously described, the longitudinal position of the follower 38 within the magazine channel 28 is directly proportional to the amount of ammunition remaining within the magazine 20. Consequently, by simply determining which of the pins 44 are in the extended position 46, e.g. by moving the soldier's finger or thumb along the side 42 of the magazine housing 22, the soldier is able to tactilely rapidly identify the longitudinal position the follower 38 and thus the amount of ammunition remaining within the magazine.

Figure 3:
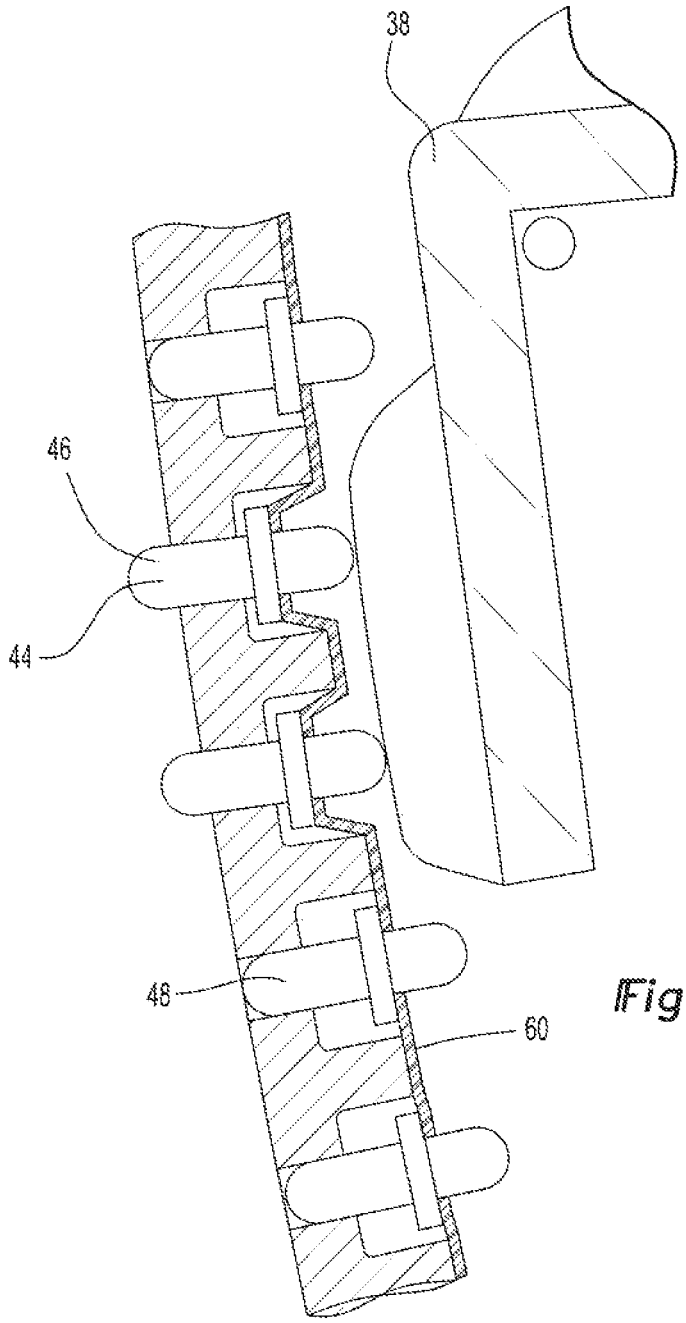
FIG. 3 is a view similar to FIG. 2 and illustrating a modification thereof.

With reference now to FIG. 3, a modification of the present invention is illustrated in which a resilient membrane 60 replaces the springs 50 of the FIG. 2 embodiment. This membrane 60 is made of an elastomeric material and is attached to the pins 44 in any conventional fashion, such as by molding, mechanically, adhesively, and/or the like.

The membrane 60 is positioned within the side 42 of the magazine housing 22 so that the membrane 60 resiliently urges the pins 44 to a retracted position 48. However, when the follower 38 is aligned with the pin, the follower 38 mechanically displaces the pin 44 to its extended position by deforming the membrane 60. When the follower 38 moves past the pin 44 in its extended position, the membrane 60 will then resiliently return the pin 44 to its retracted position 48.

A primary advantage of using a membrane 60 rather than individual springs 50 is that the membrane 60 can also serve as a seal to prevent dust and other debris from entering into the interior of the magazine 20 through the openings for the pins 44.

Figure 4:
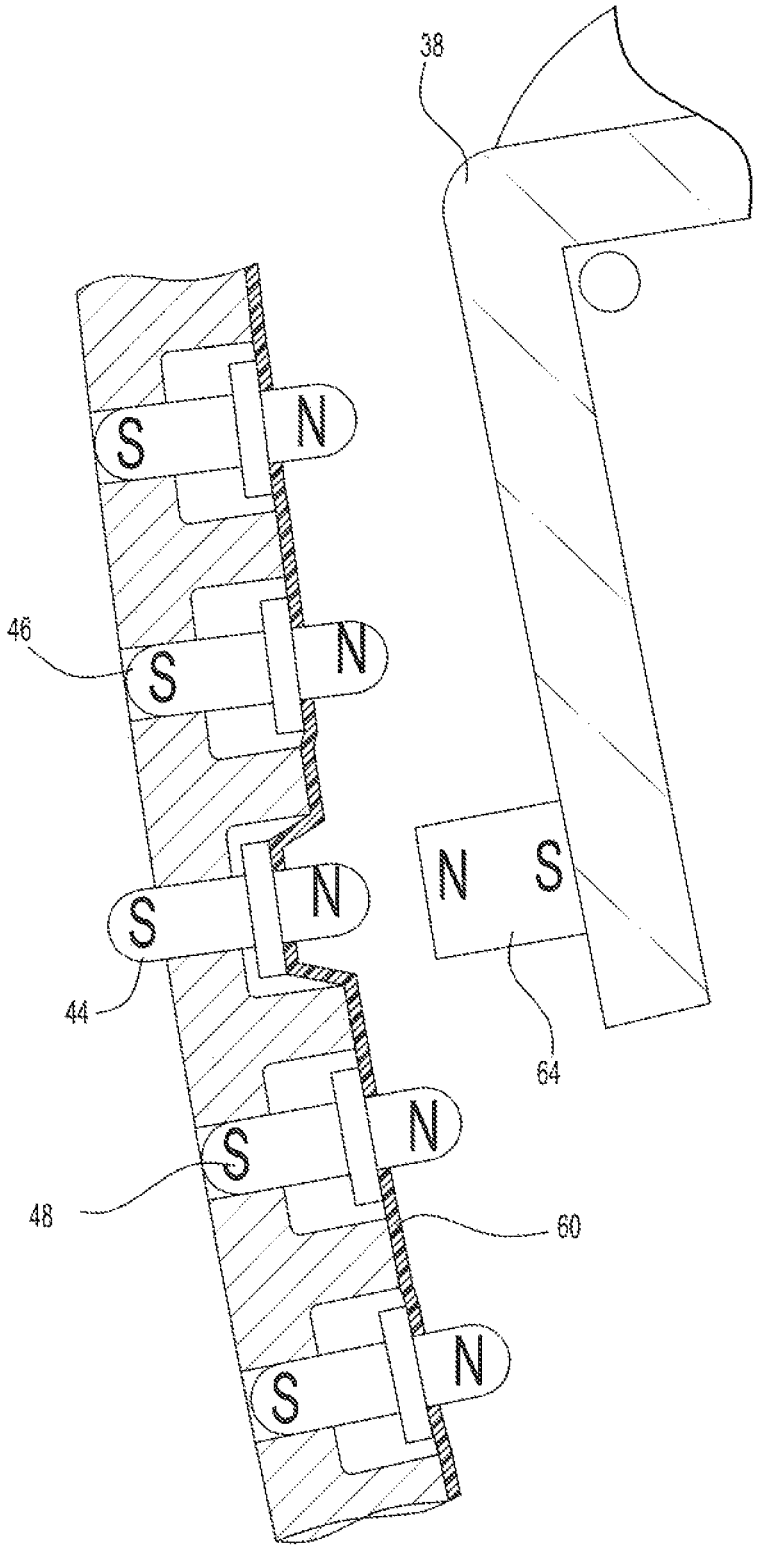
FIG. 4 is a view similar to FIG. 2 and illustrating a further modification thereof.

With reference now to FIG. 4, a still further modification of the present invention is shown in which the membrane 60 is used to urge the pins 44 to their retracted position as previously described. However, unlike the previously described embodiments of the invention, each pin 44 comprises a bar magnet having both a north and a south pole. A fixed permanent magnet 64 is then attached to the follower 38 so that, when the fixed magnet 64 registers or is aligned with the pin 44, the magnetic repulsion between the fixed magnet 64 and the indicator pin 44 aligned with the permanent magnet 64 urges the pin 44 to its extended position 46. In doing so, the pin 44 provides a tactile indicator of the position of the follower 38 and thus of the amount of ammunition remaining within the magazine.

A primary advantage of using the permanent magnet 64 on the follower 38 and its cooperation with the magnetic pins 44 is that friction, and thus mechanical wear and tear, between the follower 38 and the indicator assembly 40 is eliminated.

Figure 5:
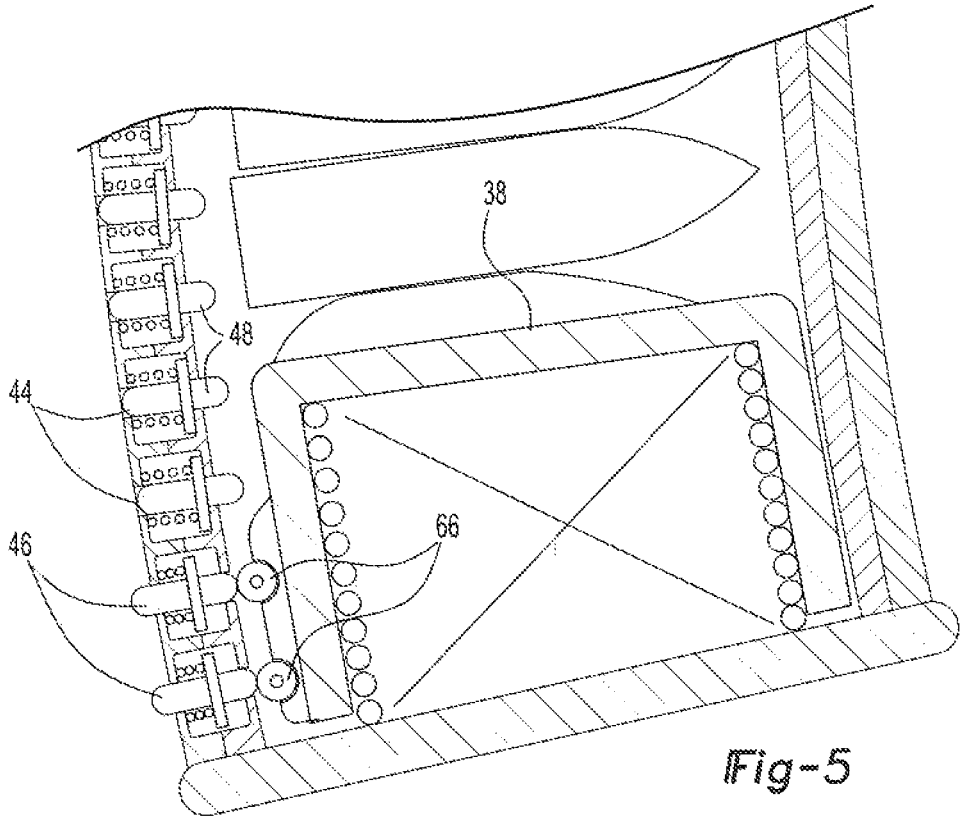
FIG. 5 is a view similar to FIG. 2 and illustrating a still further modification thereof.

With reference now to FIG. 5, a still further modification of the present invention is shown in which one or more rollers 66 are mounted to the follower 38. These rollers 66, furthermore, are dimensioned to cooperate with the pins 44 to mechanically displace the pins 44 to their extended position 46 only when the pins 44 are aligned with the rollers 66. A primary advantage of the roller 66 is that it minimizes friction between the follower 38 and the pins 44 of the tactile indicator assembly 40.

Figure 6:
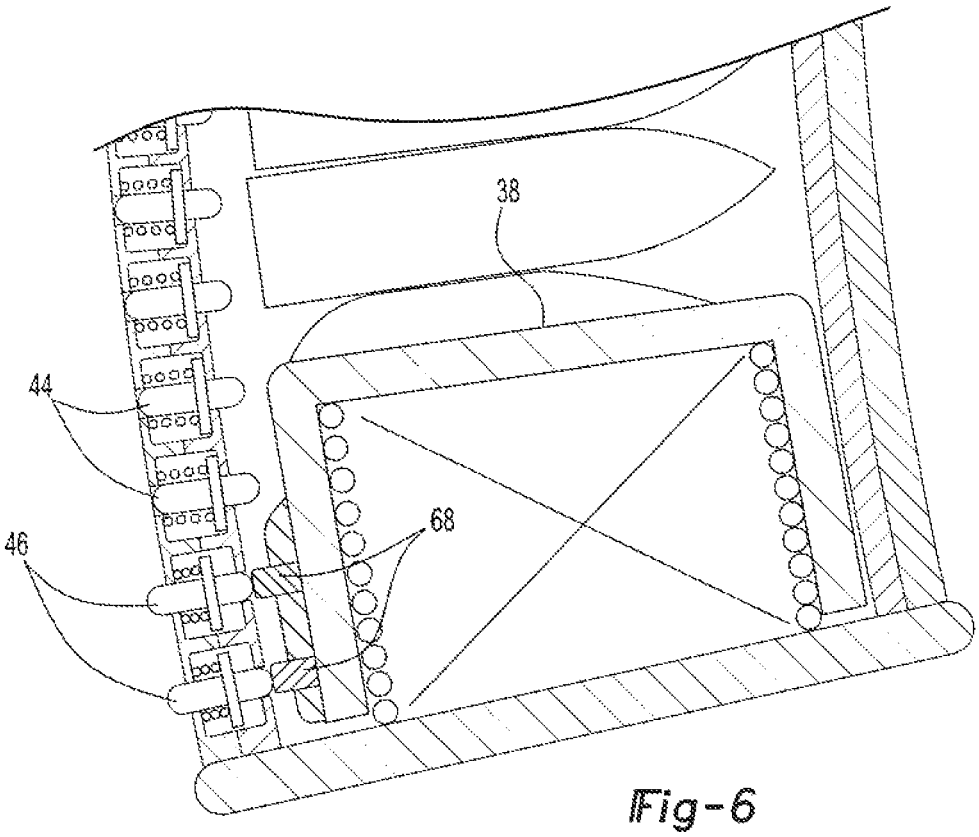
FIG. 6 is a view similar to FIG. 2 and illustrating a still further modification thereof.

With reference now to FIG. 6, a still further modification of the present invention is shown in which two pins or bars 68 are mounted to the cam follower 38 so that the bars 68 engage the pins 44 and displace the pins 44 to their extended position 46 only when the pins or bars 68 are aligned with the pins 44. The bars 68, furthermore, are preferably constructed of a hardened material which minimizes frictional wear and tear of the follower 38 from its mechanical engagement with the inner ends of the pins 44.

Figure 7:
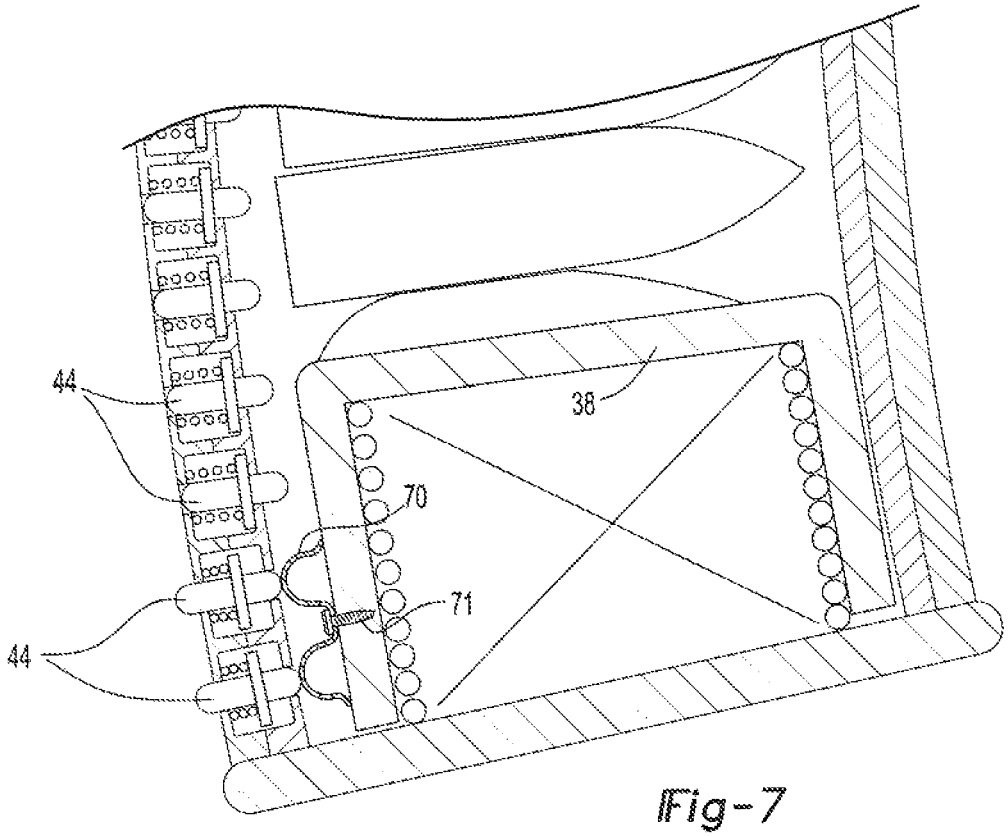
FIG. 7 is a view similar to FIG. 2 and illustrating a still further modification thereof.

With reference now to FIG. 7, a still further modification to the present invention is shown in which a leaf spring 70 is permanently attached to the follower 38 by a fastener 71. The leaf spring 70 includes one or more curved sections which engage the inner ends of the pins 44 to displace the pins 44 to their extended position when aligned with the leaf spring 70 on the cam follower 38. The leaf spring 70 thus not only provides a positive displacement of the pins to their extended position when aligned with the follower 38, but also eliminates frictional wear on the follower 38 over extended use.

Figure 8:
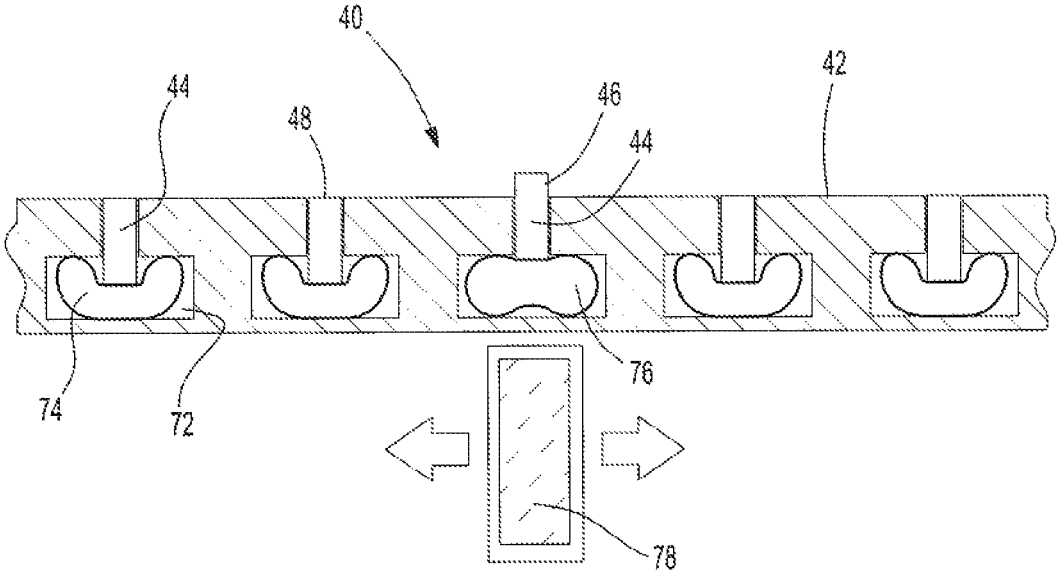
FIG. 8 is a view similar to FIG. 2 and illustrating a still further modification thereof.

With reference now to FIG. 8, a still further modification of the invention is shown in which each pin 44 is mounted within its own opening along the side 42 of the magazine housing 22. Each pin 44, furthermore, is aligned with a pocket 72 contained within the housing side 42.

A preformed elastomeric cell 74 is then positioned within each pocket 72 so that at least one cell 74 is associated with each pin 44. The cells furthermore, are filled with a smart fluid which compresses, as shown at 76, to mechanically displace its associated pin 44 to the extended position 46 when exposed to a magnetic field. A permanent magnet 78 is then attached directly to the follower 38 so that, when the magnet 78 is aligned with one or more pins 44, the cell contracts from a concave shape to a convex shape thus forcing the pin 44 to its extended position 46. A primary advantage of the elastomeric cells 74 is that the entire tactile indicator assembly 40 may be completely sealed from the interior of the magazine. The tactile indicator assembly 40 may be provided along one side, e.g. the back, of the magazine. However, if desired, multiple tactile indicator assemblies may be provided on the same magazine.

From the foregoing, it can be seen that the present invention provides a simple yet effective magazine assembly with a tactile indicator assembly by which the soldier may determine the amount of ammunition tactilely and without removing his or her eyes from the target. Furthermore, the tactile indicator assembly may be used effectively and easily by the solider at any time of day or night.

Having described my invention, many modifications thereto will become apparent to those skilled in the art to which it pertains without deviation from the spirit of the invention as defined by the scope of the appended claims.

I claim:

1. A magazine assembly comprising: an elongated housing having a channel dimensioned to contain a plurality of stacked ammunition between a first and second end of said housing, a spring loaded follower mounted in said housing and adapted to abut against one end of the stacked ammunition adjacent said second end of said housing and urge the stacked ammunition toward said first end of said housing, a tactile indicator assembly comprises a plurality of pins movably mounted to said housing at longitudinally spaced intervals between said first and second ends of said housing, in both a front and rear portion of said housing, said pins being movable between an extended and a retracted position, a resilient membrane associated with each pin which urges its associated pin toward a retracted position which urges each of said pins to said retracted position of each of said pins, and wherein said follower moves said pins via an attached ramp to said extended position when said follower is aligned with said pins said pins abut directly against said follower when aligned with said follower mounted to said housing, said tactile indicator cooperating with said follower to indicate the position of said follower between said first and second ends of said housing, the magnet being affixed to a rear portion and a front portion of said follower to communicate with pins in order to allow a user to ascertain the remaining rounds in the magazine assembly while the magazine is inserted into a partially obscuring magazine well of a firearm and said resilient membrane disposed between said ramp and said pins.

* * * * *